US006367590B1

(12) United States Patent
Burke

(10) Patent No.: US 6,367,590 B1
(45) Date of Patent: Apr. 9, 2002

(54) CUSHIONED BRAKE BEAM WEAR PLATE

(75) Inventor: Michael K. Burke, Wheaton, IL (US)

(73) Assignee: Zeftek, Inc., Montgomery, IL (US)

( * ) Notice: Subject to any disclaimer, the term of this patent is extended or adjusted under 35 U.S.C. 154(b) by 0 days.

(21) Appl. No.: 09/602,027

(22) Filed: Jun. 23, 2000

Related U.S. Application Data

(60) Provisional application No. 60/142,182, filed on Jul. 2, 1999.

(51) Int. Cl.[7] ..... B61H 13/20
(52) U.S. Cl. ..... 188/52; 188/205 R
(58) Field of Search ..... 188/52, 53, 205 R, 188/212, 214, 219.1, 233.3

(56) References Cited

U.S. PATENT DOCUMENTS

| | | | | |
|---|---|---|---|---|
| 2,350,671 A | | 6/1944 | Busch | |
| 2,365,744 A | | 12/1944 | Busch | |
| 2,553,345 A | | 5/1951 | Willis | |
| 2,808,906 A | | 10/1957 | Busch | |
| 2,918,149 A | | 12/1959 | McClure et al. | |
| 3,020,984 A | | 2/1962 | Le Beau | |
| 3,207,271 A | | 9/1965 | Polanin et al. | |
| 3,424,503 A | | 1/1969 | Schulz | |
| 4,133,434 A | | 1/1979 | Chierici | |
| 4,373,615 A | * | 2/1983 | Melinate | 188/250 B |
| 4,380,199 A | | 4/1983 | Thomson et al. | |
| 4,471,857 A | | 9/1984 | Murphy | |
| 5,421,437 A | | 6/1995 | Malachowski | |
| 5,682,964 A | | 11/1997 | Murphy | |

FOREIGN PATENT DOCUMENTS

| | | |
|---|---|---|
| AU | 143976 | 5/1949 |
| CA | 577032 | 6/1959 |

* cited by examiner

*Primary Examiner*—Christopher P. Schwartz
(74) *Attorney, Agent, or Firm*—Bell, Boyd & Lloyd LLC

(57) ABSTRACT

The present invention includes a brake beam wear plate or guide for mounting in brake beam guide brackets of railroad car truck side frames and having upper and lower walls which define a slideway for the brake beam lugs. The brake beam wear plate includes a relatively thick rubber cushioning pad on the lower wall to insulate the brake beam lug from vibration shocks and forces and thereby enhance the life of the brake beam.

21 Claims, 2 Drawing Sheets

CUSHIONED BRAKE BEAM WEAR PLATE

PRIORITY CLAIM

This application claims the benefit of U.S. Provisional Application No. 60/142,182, filed Jul. 2, 1999.

DESCRIPTION

The present invention relates in general to a cushioned brake beam wear plate, and in particular to a cushioned brake beam wear plate adapted to be mounted in a railroad truck side frame pocket to cushion the brake beam lug or extension head of a brake beam from high and low frequency vibration, impact shocks and severe upward and downward forces and thereby increase the life of the brake beam.

BACKGROUND OF THE INVENTION

Braking systems on railroad car trucks include brake beams having brake shoes for engaging the wheels to apply braking forces. The railroad car trucks include guide brackets or pockets formed on the side frames of the trucks. Steel or plastic wear plates are mounted in the guide brackets to guide the movement of the brake beams. The brake beams include extensions, extension lugs, extension heads, paddles or brake beam lugs (hereinafter referred to as "lugs" or "brake beam lugs") at opposite ends which are guidingly received in the slideways of the steel or plastic wear plates.

Plastic wear plates having self-lubricating characteristics are preferably used to overcome the potential wear problems on the brake beam lugs. An example of a plastic wear plate is disclosed in U.S. Pat. No. 4,471,857. This patent discloses a plastic wear plate having a thin rubber coating of natural rubber that preferably has a thickness in the range of from about 0.015 inch to about 0.020 inch. The thin rubber coating is suitably bonded to the exterior surface of the walls of the wear plate or integrated with the polymeric material so as to be in one piece integral relation therewith. The thin rubber coating is used to increase the friction between the plastic wear plate and the steel guide bracket to prevent the displacement of the wear plate from the guide bracket. A further plastic wear pad is provided in U.S. Pat. No. 5,692,964 which discloses a plastic brake beam wear pad for solving brake beam droop and cold flow problems (as described therein) which cause uneven wear of the brake shoes.

Railroad car truck side frames are not protected by springs or other cushioning mechanisms. As railroad cars move along the tracks or rails through varying terrain and at various speeds, the railroad car truck side frames and the guide brackets or pockets are subject to high and low frequency vibration, to impact shocks and to severe and sudden upward and downward forces. The forces can be as great as four to six times the pull of gravity ("G's"). The known steel and plastic brake beam wear plates do not adequately insulate the brake beam lugs from the vibration, shocks or forces. The brake beam lugs are thus continuously subjected to the vibration, shocks and forces during train movement. This can cause increased deterioration or wear of the brake beam and the brake beam lugs, cracks in welds in the brake beam and loosening of the riveted trusses which hold the brake beam. Accordingly, there is a need for a device which substantially dampens the high and low frequency vibration, impact shocks and sudden and severe upward and downward forces in the guide brackets or pockets of the railroad car trucks.

SUMMARY OF THE INVENTION

The present invention provides a cushioned brake beam wear plate that overcomes the above problems by absorbing high and low frequency vibration, shocks and sudden and severe upward and downward forces in the guide bracket or pocket of a railroad car truck. The cushioned brake beam wear plate of the present invention includes a substantially U-shaped member having upper and lower walls connected by an end wall and is preferably formed from a polymer material resistant to cold flow. The lower wall is thicker than the upper wall. A thick cushioning pad which is preferably rubber is positioned on the exterior side of the lower wall to dampen the high and low frequency vibration, impact shocks and severe upward and downward forces in the guide bracket. The cushioning pad may be bonded, glued, fastened or otherwise attached to the wear plate. The cushioning or rubber pad on the bottom wall has a suitable thickness and elasticity to cushion the brake beam lug received in the wear plate from vibration, shocks and forces in the guide bracket or pocket.

It is therefore an object of the present invention to provide a cushioned brake beam wear plate.

A further object of the present invention is to provide a cushioned brake beam wear plate which dampens the vibration, shocks and forces on the brake beam lug received in the wear plate.

Other objects, features and advantages of the invention will be apparent from the following detailed disclosure, taken in conjunction with the accompanying sheets of drawings, wherein like numerals refer to like parts.

DETAILED DESCRIPTION OF THE INVENTION

Figure 1:
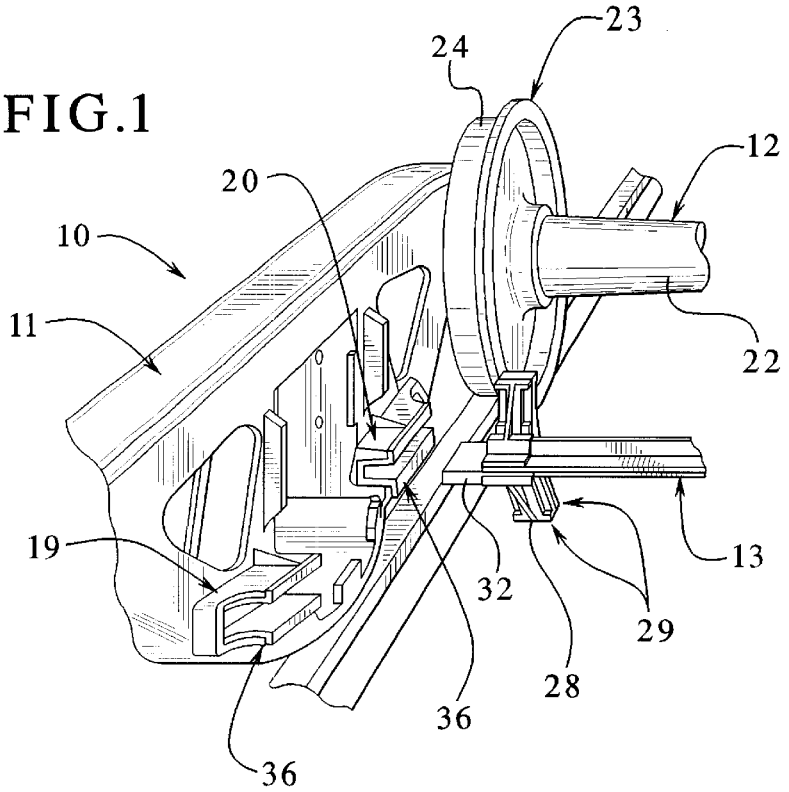
FIG. 1 is a fragmentary perspective view of a side frame of a standard railroad car truck and braking elements with some parts omitted for purposes of clarity and other parts in exploded position.
Figure 2:
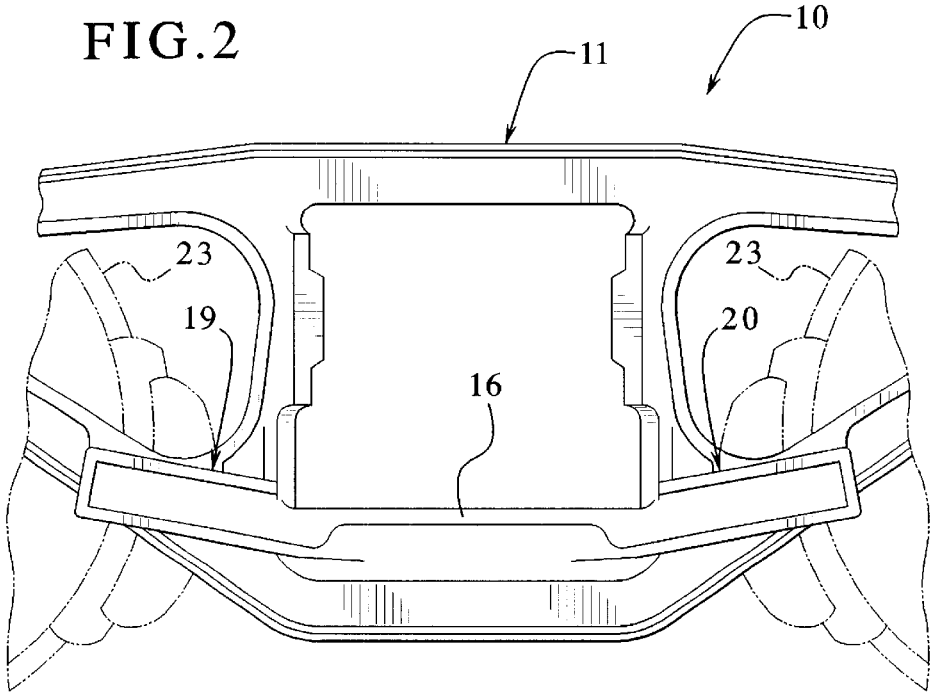
FIG. 2 is a fragmentary inside view of the side frame to illustrate the guide brackets of the truck.
Figure 3:
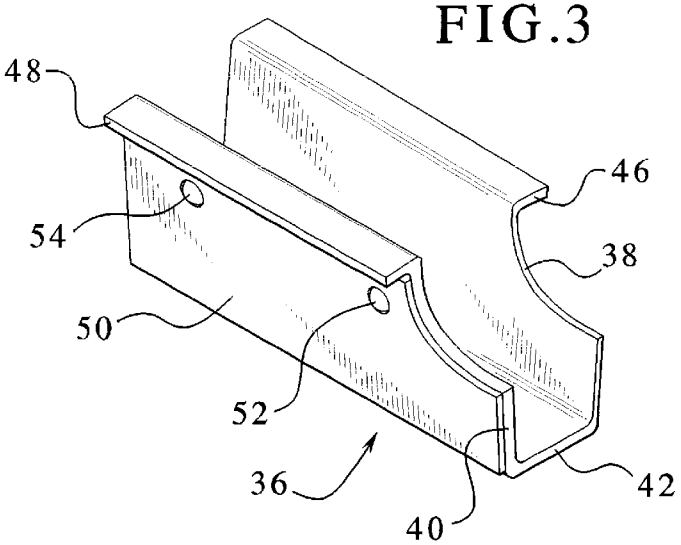
FIG. 3 is a perspective view of the brake beam wear plate of the present invention.
Figure 6:
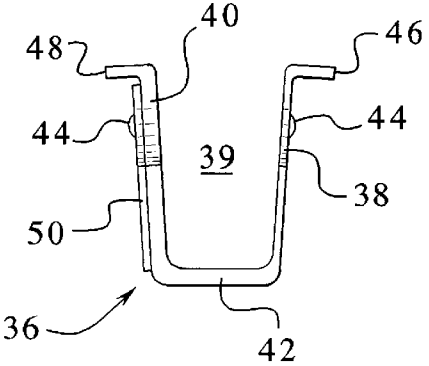
FIG. 6 is an end elevational view of the brake beam wear plate of the present invention.
Figure 4:
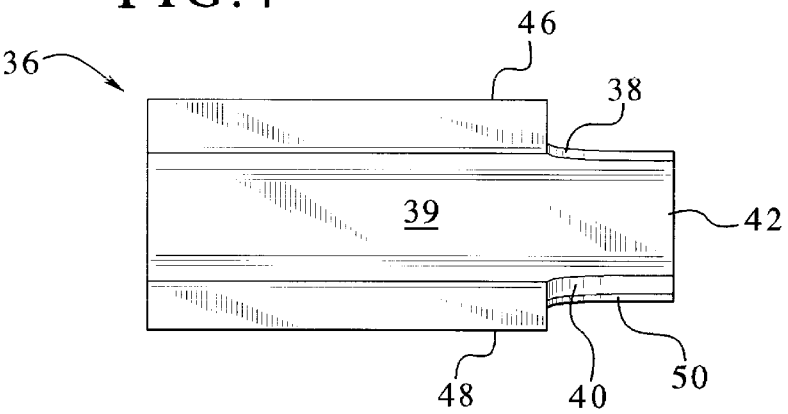
FIG. 4 is a top plan view of the brake beam wear plate of the present invention.
Figure 5:
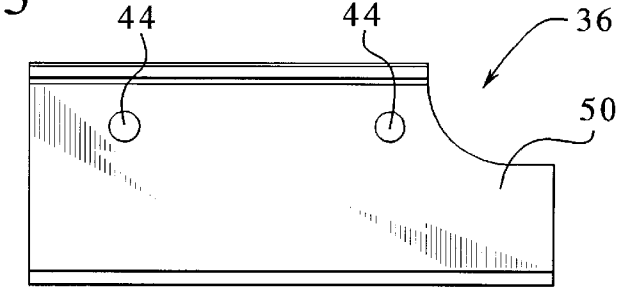
FIG. 5 is a side elevational view of the brake beam wear plate of the present invention.

For purposes of understanding the brake beam wear plate of the present invention, only a portion of a railroad car truck is illustrated in FIGS. 1 and 2. While railroad car trucks may vary in structure, they generally include opposed side frames resting on wheeled axles, a bolster for interconnection with the railroad car and a braking mechanism. As appreciated by one of ordinary skill in the art, the braking mechanism includes two brake beams, a brake shoe for each wheel mounted at the appropriate position on the brake beams and a common drive or actuating mechanism for causing the brake beams to move between braking and non-braking positions.

More specifically, the railroad car truck 10 illustrated in FIGS. 1 and 2 includes a side frame 11, a wheeled axle 12 and a brake beam 13. Although not shown, the truck includes a corresponding opposed spaced apart side frame. Each side frame 11 includes a pair of brake beam guide brackets or pockets 19 and 20. The side frames are usually cast steel or iron and the guide brackets 19 and 20 are cast into the side frames. The wheeled axle 12 includes an axle 22 and opposed wheels 23 having brake shoe engaging surfaces 24. Each guide bracket defines a U-shaped pocket adapted to receive a wear plate 36 and each end of the brake beam includes a brake beam lug 32. The wear plate 36 receives the brake beam lug 32 of the brake beam to guide the movement of the brake beam toward the respectively adjacent wheel. The brake beam lug 32 is adapted to be received by the wear plate 36 in the guide bracket although it is shown in removed position in FIG. 1. This substantially rectangular lug 32 is generally made of steel and therefore would be subject to steel-on-steel contact if the brake beam wear plate were also made of steel.

The brake beam wear plate 36 of the present invention is illustrated in greater detail in FIGS. 3, 4, 5 and 6 prior to being mounted in the pocket of a guide bracket. The wear plate 36 is generally U-shape in cross section and includes spaced-apart opposed first or upper and second or lower walls 38 and 40, respectively. The upper and lower walls 38 and 40 are integrally connected by an interconnecting or end wall 42. The slidway 39 defined between the upper wall 38 and the lower wall 40 permits an adequate area for the movement of the brake beam lug 32 (FIG. 1) as the brakes are applied and released.

The exterior dimensions of the wear plate 36 are such as to matingly conform to the pocket of the guide bracket. As shown in rest position in FIGS. 3, 4, 5 and 6, the upper and lower walls 38 and 40 generally diverge, and are brought into substantial parallel relation when the wear plate 36 is mounted in the guide bracket 20 (FIG. 1). The memory of the wear plate 36 will cause the upper and lower walls to want to return to their normal or resting position, and in this respect apply a retaining force to assist in holding the wear plate 36 in position in the guide bracket 20 (FIG. 1). The exterior surfaces of the upper and lower walls preferably include detents 44 for mating with indents (not shown) formed in the interior surface of the walls of the guide bracket. The detents 44 co-act with the memory characteristics of the wear plate 36 to retain the wear plate 36 in position in the guide bracket or pocket as is well known in the art. The upper and lower walls 38 and 40 include lips 46 and 48, respectively at the free edges of the walls to seat on the guide bracket and properly position the wear plate in the guide bracket, as well as to properly position the detents in the indents.

The lower wall 40 of the wear plate 36 is substantially thicker than the upper wall 38 to provide the proper structural integrity to the wear plate 36 primarily because the lower wall 40 will sustain greater forces than the upper wall 38 due to gravity and the weight of the brake beam. The thicker lower wall 40 will increase or enhance the life of the wear plate 36. Preferably, the upper wall 38 has a thickness of approximately 0.150 inch and the lower wall has a thickness of approximately 0.250 inch although the thicknesses could vary. The thinner upper wall 38 also provides additional space in the guide bracket to accommodate the cushioning or rubber pad 50 on the wear plate 36 as described below while allowing for a sufficiently sized slideway 39 for the lug 32.

The wear plate 36 includes a relatively thick cushioning pad 50 positioned on the lower wall 40. The cushioning pad preferably has a thickness of approximately 0.063 inch thickness although the thickness could vary. The pad 50 is preferably permanently bonded or glued to the exterior surface of the bottom wall; however, it should be appreciated that the rubber pad could be suitably fastened to the bottom wall using counter sunk rivets or other suitable fasteners. Although not shown, the pad 50 could include front and back attaching lips which wrap around the front and back edges of the end wall 42 to hold the pad 50 on the end wall 42. The pad is preferably a rubber pad which preferably has a 40A–50A durometer hardness. It should also be appreciated that the pad could be made from other materials having a suitable hardness such as urethane.

The cushioning or rubber pad 50 preferably is of the same shape as the lower wall 40 and covers substantially the entire exterior surface of the lower wall 40 (excluding the lip or flange 48). The cushioning or rubber pad 50 may include two circular slots 52 and 54 aligned with the detents 44 which enable the detents to extend through the pad 50 into the indents in the guide bracket. Alternatively, the cushioning or rubber pad 50 could cover the detents 44 and the section of the pad 50 covering the detents could extend into the indents provided in the guide bracket.

The cushioning or rubber pad substantially dampens the high and low frequency vibration, impact shocks and severe and sudden upward and downward forces in the guide bracket and thereby cushions the brake beam lugs from the continuous vibrations, shocks and sudden and severe upward and downward forces experienced during movement of the train.

The upper wall, lower wall and body of the wear plate are preferably molded from a suitable polymer such as a suitable glass-filled urethane. One satisfactory polymer is marketed by B.F. Goodrich. Where lubrication is desired, the lubricating agent may be molybdenum disulphate, silicone, polytetra-fluorethylene, or an equivalent and added to the urethane. Further, a super high-impact polypropylene, a filled nylon or a polycarbonate or a virgin or filled U.H.M-.W.P.E. may be used. All of these polymers are resistant to cold Although not shown, the walls 38 and 40 of the wear plate 36 could be formed as. described in U.S. Pat. No. 5,682,964 which is incorporated herein by reference. The walls would then have an unequal thicknesses throughout their length, thereby defining a slideway having a longitudinal axis that is inclined fifteen degrees from the horizontal axis causing the brake beam lug to move from left to right at an upward incline of thirteen degrees because of the slop needed to properly allow release of the brakes and downward gravitational movement of the brake beam. The thirteen degree path produces the ideal clasping relation between the shoes and wheels. The wall thicknesses are such that a slop fit is produced for the lug so that the lugs may easily slide in the wear plate when the brakes are released. The angle of the slideway compensates for the droop inherent in the fit of the lug and provides for the substantially perfect clasping of the brake shoe with the wheel, thereby resulting in uniform wear along the brake shoe to provide the most efficient braking and enhance brake shoe life. The relatively thick cushioning pad is mounted on the exterior side of lower wall as described above.

It should also be appreciated that the cushioning or rubber pad of the present invention could be attached to a metal or steel wear plate to absorb high and low frequency vibration, shocks and sudden and severe upward and downward forces in the guide bracket or pocket of a railroad car truck.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A brake beam wear plate for a brake beam guide bracket on a side frame of a railroad car truck including at least one axle carrying a pair of wheels, said brake beam wear plate comprising:

a U-shaped body having spaced-apart upper and lower walls and an interconnecting wall, said upper and lower walls and interconnecting wall adapted to fit in said brake beam guide bracket and defining a slideway for an end of a brake beam, said lower wall having an exterior side; and a relatively thick cushioning pad positioned on the exterior side of the lower wall, whereby the cushioning pad dampens vibration, impact shocks and forces in the brake beam guide bracket and cushions the brake beam from the vibrations, shocks and forces experienced during movement of the railroad car truck.

2. The brake beam wear plate of claim 1, wherein the lower wall is thicker than the upper wall.

3. The brake beam wear plate of claim 2, wherein the upper wall has a thickness of about 0.150 inch and the lower wall has a thickness of about 0.250 inch.

4. The brake beam wear plate of claim 3, wherein the cushioning pad has a thickness of about 0.063 inch.

5. The brake beam wear plate of claim 1, wherein the body is molded from a polymer.

6. The brake beam wear plate of claim 5, wherein the body is molded from a glass-filled urethane.

7. The brake beam wear plate of claim 1, wherein the body is metal.

8. The brake beam wear plate of claim 1, wherein the upper wall and the lower wall diverge outwardly from the interconnecting wall.

9. The brake beam wear plate of claim 1, wherein the lower wall has a lip at a free edge of the lower wall opposite the interconnecting wall to properly position the brake beam wear plate in the brake beam guide bracket.

10. The brake beam wear plate of claim 1, wherein the exterior side of the lower wall includes an exterior surface of the lower wall and cushioning pad is bonded to the exterior surface of the lower wall.

11. The brake beam wear plate of claim 1, wherein the exterior side of the lower wall includes an exterior surface of the lower wall and cushioning pad is glued to the exterior surface of the lower wall.

12. The brake beam wear plate of claim 1, wherein the exterior side of the lower wall includes an exterior surface of the lower wall and cushioning pad is fastened to the exterior surface of the lower wall by at least one fastener.

13. The brake beam wear plate of claim 1, wherein the cushioning pad has at least one attaching lip that wraps around at least one of the edges of the lower wall to secure the cushioning pad to the lower wall.

14. The brake beam wear plate of claim 1, wherein the cushioning pad is substantially the same shape as the lower wall and covers substantially the entire exterior side of the lower wall.

15. The brake beam wear plate of claim 1, wherein exterior side of the lower wall includes an exterior surface of the lower wall and said exterior surface of the lower wall includes at least one detent for mating with at least one indent formed in an interior surface of a bottom wall of the brake beam guide bracket.

16. The brake beam wear plate of claim 15, wherein the cushioning pad defines at least one hole aligned with the detent on the exterior surface of the lower wall.

17. The brake beam wear plate of claim 15, wherein the cushioning pad covers the detent of the exterior surface of the lower wall, whereby a section of the cushioning pad covering the detent extends into the indent of the interior surface of the bottom wall of the brake beam guide bracket.

18. The brake beam wear plate of claim 1, wherein the cushioning pad is rubber.

19. The brake beam wear plate of claim 18, wherein the cushioning pad has a 40A–50A durometer hardness.

20. The brake beam wear plate of claim 1, wherein the cushioning pad is urethane.

21. The brake beam wear plate of claim 1, wherein the cushioning pad has a thickness of about 0.063 inch.

* * * * *